United States Patent [19]

Taniguchi

[11] Patent Number: 4,903,080

[45] Date of Patent: Feb. 20, 1990

[54] COPY PAPER SEPARATOR FOR ELECTROPHOTOGRAPHIC COPYING MACHINE

[75] Inventor: Hideo Taniguchi, Yamayatokoriyama, Japan

[73] Assignee: Sharp Kabushiki Kaisha, Osaka, Japan

[21] Appl. No.: 314,254

[22] Filed: Feb. 21, 1989

Related U.S. Application Data

[63] Continuation of Ser. No. 249,399, Aug. 29, 1988, abandoned, which is a continuation of Ser. No. 131,283, Dec. 10, 1987, abandoned, which is a continuation of Ser. No. 892,316, Aug. 4, 1986, abandoned.

[30] Foreign Application Priority Data

Aug. 29, 1985 [JP] Japan ..... 60-191438

[51] Int. Cl.[4] ..... G03G 15/14; G03G 15/16

[52] U.S. Cl. ..... 355/274; 355/271

[58] Field of Search ..... 355/3 R, 3 CH, 3 TR, 355/271, 274, 219, 221, 273

[56] References Cited

U.S. PATENT DOCUMENTS

| | | | |
|---|---|---|---|
| 3,620,617 | 11/1971 | Kelly et al. | 355/3 TR |
| 4,542,977 | 9/1985 | Kamogawa et al. | 355/3 CH |

FOREIGN PATENT DOCUMENTS

| | | | |
|---|---|---|---|
| 3149934 | 6/1983 | Fed. Rep. of Germany | 355/3 CH |
| 24864 | 2/1984 | Japan | 355/3 CH |
| 218470 | 12/1984 | Japan | 355/3 TR |
| 97372 | 5/1985 | Japan | 355/3 R |
| 244979 | 12/1985 | Japan | 355/3 CH |

*Primary Examiner*—Arthur T. Grimley
*Assistant Examiner*—Ed Pipala
*Attorney, Agent, or Firm*—Flehr, Hohbach, Test, Albritton & Herbert

[57] ABSTRACT

A copy paper separator is disposed opposite to a surface of a photosensitive body in an electrophotographic copying machine. A transfer charger for transferring images to copy paper and a separation charger for helping the paper to separate from the photosensitive body are adjacent to each other. A sheet made of a narrow belt-like insulator is disposed between the separation charger wire and the photosensitive body and an insulative plate is disposed at the boundary between chargers such that the copy paper can be effectively separated.

3 Claims, 2 Drawing Sheets

COPY PAPER SEPARATOR FOR ELECTROPHOTOGRAPHIC COPYING MACHINE

Figure 1:
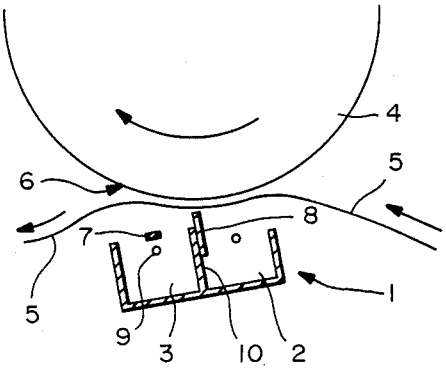

This is a continuation of application Ser. No. 240,399 filed Aug. 29, 1988, now abandoned, which is a continuation of application Ser. No. 131,283 filed Dec. 10, 1987, now abandoned, which is a continuation of application Ser. No. 892,316 filed Aug. 4, 1986, now abandoned.

This invention relates to a copy paper separator for use in an electrophotographic copying machine and more particularly to such a copy paper separator provided with insulative members disposed appropriately such that copy paper can be dependably separated from the photosensitive body from which images are transferred while the undesirable phenomenon of whitening which tends to occur during the separation process can be prevented.

After a transfer charger is used in a copying machine to transfer toner images onto a copy paper from the surface of a photosensitive body (drum), a separation charger is used to subject the paper to an AC corona discharge to weaken the force with which the copy paper tends to remain attached to the drum surface. In order to make the copy paper dependably removable, however, the discharge of the separation charger must be such that the current through the drum (drum current) caused by the separation charger must be greater than a certain value. If the value of the drum current is greater than this value, on the other hand, there is a tendency that images near the front edge of the copy paper fail to be properly transferred. This happens especially if the original has large white sections and such areas tend to remain white. For this reason, it was previously considered difficult to carry out the copy paper separation process dependably while preventing the whitening of the paper merely by adjusting the value of the drum current. Attempts may be made in view of the above to change the position of the separation charger wire but this has only the effect of changing the position of separation and whitening can hardly be prevented by this method. Although this problem can be solved by providing two wires to the separation charger, this unreasonably increases the cost of the charger.

It is therefore an object of the present invention to provide a copy paper separator for an electrophotographic copying machine which can not only separate copy paper dependably from the photosensitive drum but also prevent whitening which tends to result when a copy paper is separated.

The above and other objects of the present invention are achieved by providing a separator with a separation charger and a transfer charger and adding thereto a charge controlling sheet of a narrow belt-like insulative material between the separation charger wire and the surface of the photosensitive drum and a plate-like insulative separator member at the boundary between the separation and transfer chargers such that there is formed a gap with the photosensitive drum surface.

With a copy paper separator structured as explained above, the ability of the separation charger to remove charge from the drum surface can be appropriately controlled while the undesirable phenomenon of whitening can be prevented. Although this charge controlling sheet tends also to inhibit the ability of the separation charger to make the copy paper easily removable, the insulative plate disposed at the boundary between the separation and transfer chargers has the effect of helping the copy paper to separate effectively from the drum surface.

Figure 3:
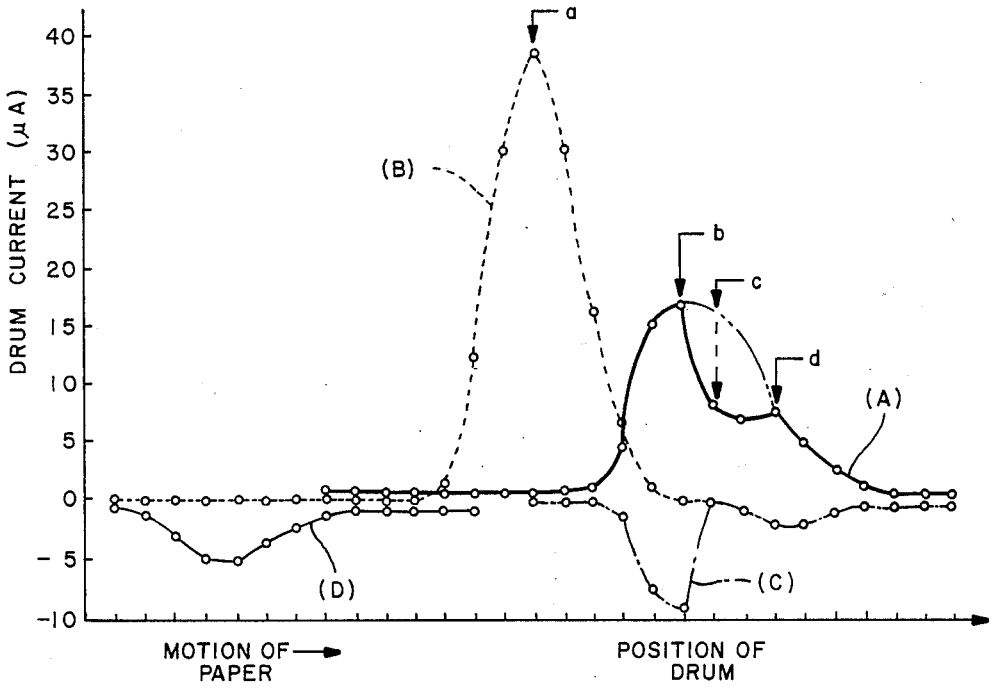
Figure 4:
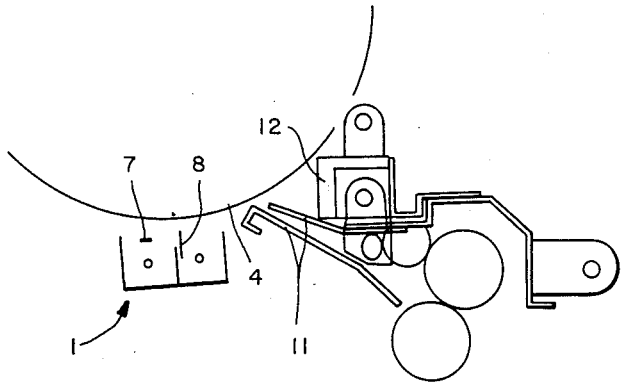

The accompanying drawings, which are incorporated in and form a part of the specification, illustrate one embodiment of the present invention and, together with the description, serve to explain the principles of the invention. In the drawings FIG. 1 is a side sectional view of a copy paper separator according to one embodiment of the present invention, FIG. 2 is a diagonal sectional view of the copy paper separator of FIG. 1, FIG. 3 is a graph showing the distribution of drum current caused by the copy paper separator of FIGS. 1 and 2, and FIG. 4 is a side sectional view of the copy paper separator FIGS. 1 and 2 with a pre-charge removing charger provided thereto.

Figure 2:
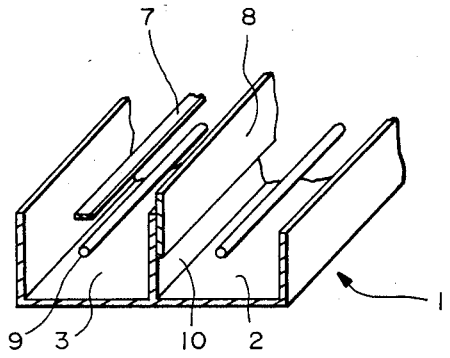

As shown in FIGS. 1 and 2, a copy paper separator 1 according to one embodiment of the present invention comprises a transfer charger 2 and a separation charger 3. The transfer charger 2 is for providing a positive corona discharge from the back of a copy paper 5 attached to the surface of a photosensitive body (drum) 4 to transfer toner images on the drum surface onto the copy paper 5. The separation charger 3 provides an AC corona discharge to the copy paper 5 on which toner images have been transferred, thereby weakening the force which causes the copy paper 5 to remain attached to the drum surface and making it easier to remove the paper 5 by means of a blade-like piece 6.

The copy paper separator 1 according to this embodiment of the present invention further includes a charge controlling sheet 7 disposed in the separator charger 3 and a separator plate 8 placed at the boundary between the transfer charger 2 and the separation charger 3. As the charge controlling sheet 7, a thin belt-like insulative strip of polyester sheet may be stretched along the separation charger wire 9 between this separation charger wire 9 and the drum surface and approximately parallel to the copy paper 5. If this charge controlling sheet 7 is disposed too close to the transfer charger 2, whitening can be more effectively prevented but the paper 5 becomes more difficult to separate. If it is disposed too far from the transfer charger 2, on the other hand, the paper 5 becomes more easily separable but whitening cannot be prevented to effectively. Thus, this charge controlling sheet 7 is so positioned that whitening can be prevented sufficiently dependably while the copy paper can be removed reasonably easily.

As the separator plate 8 which is an insulative plate-like object, use may be made of a polyester sheet used for the charge controlling sheet 7 but made wider than the charge controlling sheet 7. The separator plate 8 thus prepared is attached to the partition plate 10 between the transfer charger 2 and the separation charger 3 with its larger side protruding towards the drum surface such that there is a gap of a certain width between the edge of its longer side and the surface of the photosensitive drum 4. The ability of the separator to make the copy paper removable becomes improved if the separator plate 8 is attached to the partition plate 10 such that the gap between the longer side edge of this separator plate 8 and the drum surface is made narrow but this tends to increase the risk of whitening. If this gap is made too wide, on the other hand, the danger of whitening is diminished but the paper on the drum surface becomes less readily separable. Accordingly, the separator plate 8 is positioned such that whitening can be prevented while the ability of the copy paper separator to separate the paper is not adversely affected.

FIG. 3 shows the distribution of drum current when a copy paper separator of this invention is utilized. The drum current distribution of FIG. 3 was obtained by attaching sheet-like electrodes on the surface of the photosensitive drum 4 with the pitch of 3 mm and measuring the currents flowing into the individual electrodes at each discharge. The broken line (B) in FIG. 3 shows the drum current distribution by the transfer charger 2. The solid line (A) shows the drum current distribution by the separation charger 3. After the drum current by the transfer charger 2 reaches a maximum value at the point a and the transfer of toner images to the copy paper 5 is effected, the drum current decreases rapidly because of the additional existence of the separator plate 8. In other words, the transfer charger 2 is thereby prevented from adversely affecting the ability of the separation charger 3 to make the paper 5 easier to separate.

Next, separation of paper is effected by the drum current caused by the separation charger 3 at the point b. If the charge controlling sheet 7 were not present, the drum current by the separation charger 3 would be distributed as shown by the chain line and whitening would take place at the point c because an excessive amount of charge would have been removed. The charge controlling sheet 7 serves to drop the current at the point c as shown by the broken arrow at the point c so as to prevent the occurrence of whitening. At the point d, however, the drum current increases again because the charges begin to miss the narrow sheet 7. In other words, the copy paper attached on the drum surface can still be separated by the discharge.

In summary, the copy paper separator 1 of the present invention is provided with a charge controlling sheet 7 by means of which the charge-removing ability of the separator charger 3 can be properly controlled and whitening of images can be prevented. Moreover, the separator plate 8 is adapted to make up for the ability to separate which also becomes inhibited by the charge controlling sheet 7. Thus, the present invention provides an inexpensive apparatus with simple structure which can separate copy paper efficiently from the photosensitive body while whitening can be prevented from occurring.

In FIG. 3, the broken line (C) represents the portion of bias by the separation charger 3. The thin solid line (D) shows the distribution of drum current due to a pre-charge removing charger 12 which may be provided as shown in FIG. 4 immediately upstream to copy paper guide means 11 with respect to the motion of the photosensitive drum 4. This pre-charge removing charger 12 serves to improve the ability of the separator to make the copy paper separable by removing the charge from the surface of the drum 4 after the images are developed. It thus prevents the occurrence of whitening and hence improves the overall efficiency of the copy paper separator 1.

The foregoing description of a preferred embodiment of the invention has been presented for purposes of illustration and description. It is not intended to be exhaustive or to limit the invention to the precise form disclosed, and many modifications and variations are possible in light of the above teaching. Such modifications and variations which may be apparent to a person skilled in the art are intended to be included within the scope of this invention.

What is claimed is:

1. In a copy paper separator disposed opposite to a photosensitive body surface and having a separation charger with a charger wire therein and a transfer charger adjacent to said separation charger and having a boundary wall with said separation charger, the improvement comprising an elongated charge controlling sheet made of a narrow belt-like insulator designed and disposed between said charger wire and said photosensitive body surface such that, when said separation charger is discharged, the total charge received by said photosensitive body surface from said charger wire is significantly less but the maximum current on said photosensitive body surface received from said charger wire is not less than if said charge controlling sheet were absent, and an insulative separator plate attached to said boundary wall protrudingly towards said photosensitive body surface so as to form an adjustably determined gap between said insulative separator plate and said photosensitive body surface, whereby whitening of copy paper processed on said photosensitive body surface is reduced.

2. The copy paper separator of claim 1 wherein said charge controlling sheet is disposed parallel to said photosensitive body surface.

3. The copy paper separator of claim 1 wherein said gap is so adjusted as to help copy paper to separate efficiently from said photosensitive body surface without causing whitening of said copy paper.

* * * * *